US006893060B2

(12) United States Patent
Ng

(10) Patent No.: US 6,893,060 B2
(45) Date of Patent: May 17, 2005

(54) DOOR LATCH FOR ALARM SYSTEM

(76) Inventor: William Ng, 4615 18th St. East, Bradenton, FL (US) 34203-3757

( * ) Notice: Subject to any disclaimer, the term of this patent is extended or adjusted under 35 U.S.C. 154(b) by 52 days.

(21) Appl. No.: 10/364,939

(22) Filed: Feb. 12, 2003

(65) Prior Publication Data

US 2003/0164615 A1 Sep. 4, 2003

Related U.S. Application Data

(60) Provisional application No. 60/356,852, filed on Feb. 13, 2002.

(51) Int. Cl.[7] ..... E05C 17/56
(52) U.S. Cl. ..... 292/251.5; 70/417
(58) Field of Search ..... 292/251.5, 144; 70/276, 417; 109/82–85

(56) References Cited

U.S. PATENT DOCUMENTS 1,606,524 A * 11/1926 Gilpin ..... 105/280
3,334,936 A * 8/1967 Hekelaar et al. ..... 292/251.5
3,665,737 A * 5/1972 Reese ..... 70/118
3,794,366 A * 2/1974 Graham ..... 292/144
4,331,355 A * 5/1982 Okuno ..... 292/251.5
4,790,579 A * 12/1988 Maxwell et al. ..... 292/175
4,998,634 A * 3/1991 Nessfield ..... 220/1.5
5,174,509 A * 12/1992 Starke et al. ..... 241/24.14
5,934,115 A * 8/1999 Bernier et al. ..... 70/208
6,124,792 A * 9/2000 Shoen et al. ..... 340/545.2
6,719,334 B1 * 4/2004 Curtis ..... 292/281

* cited by examiner

*Primary Examiner*—Gary Estremsky
(74) *Attorney, Agent, or Firm*—Gifford, Krass, Groh, Sprinkle, Anderson & Citkowski, P.C.

(57) ABSTRACT

Door-lock hardware is constructed of corrosion-resistant material such as stainless steel. Such a material lacks magnetic properties to permit use in association with magnetic switches coupled to signal alarm and security systems. However, according to the preferred embodiment of the invention, a door latch of stainless steel or other non-magnetic material includes a ferrous-coated tongue portion to maintain compatibility with such monitors and alarms while providing a higher level of rust- and corrosion-resistance.

8 Claims, 2 Drawing Sheets

DOOR LATCH FOR ALARM SYSTEM

REFERENCE TO RELATED APPLICATION

This application claims priority from U.S. Provisional Patent Application Ser. No. 60/356,852, filed Feb. 13, 2002, the entire content of which is incorporated herein by reference.

FIELD OF THE INVENTION

This invention relates to door locks and, more particularly, to door locks suitable for use with alarm or security systems.

BACKGROUND OF THE INVENTION

Particularly in the self-storage industry, multiple storage units are made available and are leased to consumers requiring semi-permanent storage. Door locks at such facilities are of great importance to give both the managers of the storage facility and customers independent access and the required security. Also, it is important, particularly with outdoor access to storage areas to provide door locks, which will withstand adverse weather conditions that may lead to rust and corrosion. In an effort to avoid deterioration and corrosion, it is desirable to use corrosion and rust resistant materials such a premium grades of stainless steel. Unfortunately, such materials, although desirable for producing door latches, are non-magnetic and preclude the use of alarm and security systems using magnetic switches.

An elucidating background is set forth in U.S. Pat. No. 6,249,224. The disclosed alarm switch assembly includes a housing having first and second surfaces and an opening defined therein that extends from one surface-toward the other surface. The opening is further defined by at least four inner surfaces. A magnetic field generating device is disposed adjacent the opening and between the first and second surfaces, and a switch is disposed adjacent the opening and is opposed to the magnetic field generating device. More particularly, a magnet chamber and switch chamber are defined on opposite sides of a latch-receiving slot. When the latch is in its closed position, thus being fully inserted in latch slot, the magnetic field produced by magnet is "blocked" by the metal slidable door latch, thereby maintaining alarm switch in the "closed" position. Given that only ferrous materials can "block" a magnetic field, the latch in this and other known configurations is iron-containing, probably ferrous steel.

The point of novelty of the '224 has to do with clearances as opposed to materials. The slot is preferably dimensioned such that a slidable door latch fits therein with a relatively small amount of clearance on each side, preventing a "dummy" latch to be inserted therein. As used therein, a "dummy" latch is an object that can be inserted between slidable door latch an inner surface of the slot such that when the latch is withdrawn, the object "blocks" the magnetic field produced by magnet and prevents same from affecting alarm switch. Given that even this tamper-resistant configuration includes a latch subject to corrosion, the need remains for an improved more weather-resistant alternative.

SUMMARY OF THE INVENTION

There is a need for door lock hardware made of corrosion resistant material such as stainless steel that lacks magnetic properties to permit use in association with magnetic switches that signal alarm and security system conditions.

Therefore it is an object of this invention to provide a door latch of non-magnetic stainless steel material capable of resisting rust and corrosion but with magnetic qualities to be compatible with alarm and security systems that incorporate magnetic switches.

DETAILED DESCRIPTION OF THE INVENTION

Figure 1:
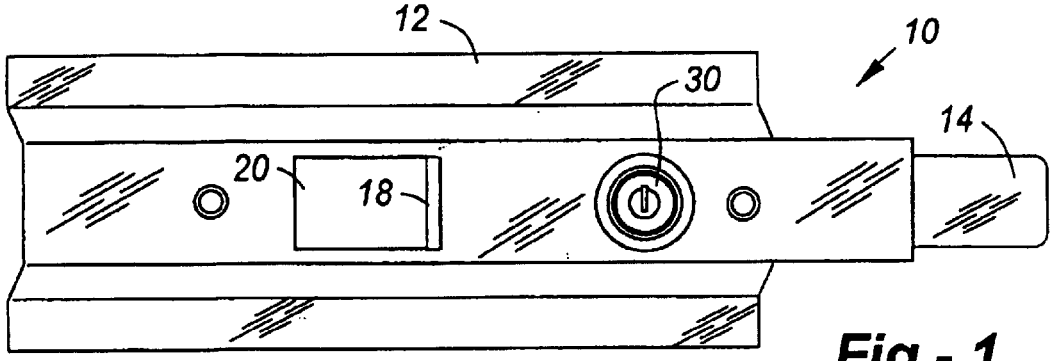
FIG. 1 is a perspective view in the form of a photograph of a door latch mechanism of the type that can utilize the invention.

Referring to the figures and particularly to FIG. 1, a latch mechanism of the type used with self-storage systems is designated generally at 10 and includes a body member 12 slidably supporting a moveable tongue or slide bar 14. The bar 14 is disposed between the outer rear of the body member 12 and the outer surface of door 16. The bar 14 is adapted to slide horizontally in a limited range defined by the handle 18 protruding from the bar 14 through an opening 20 in the body member 12. A backing plate 22 is disposed on the back side of the door 16 in alignment with the body member 12 to secure the latch assembly 10 in position.

Figure 2:
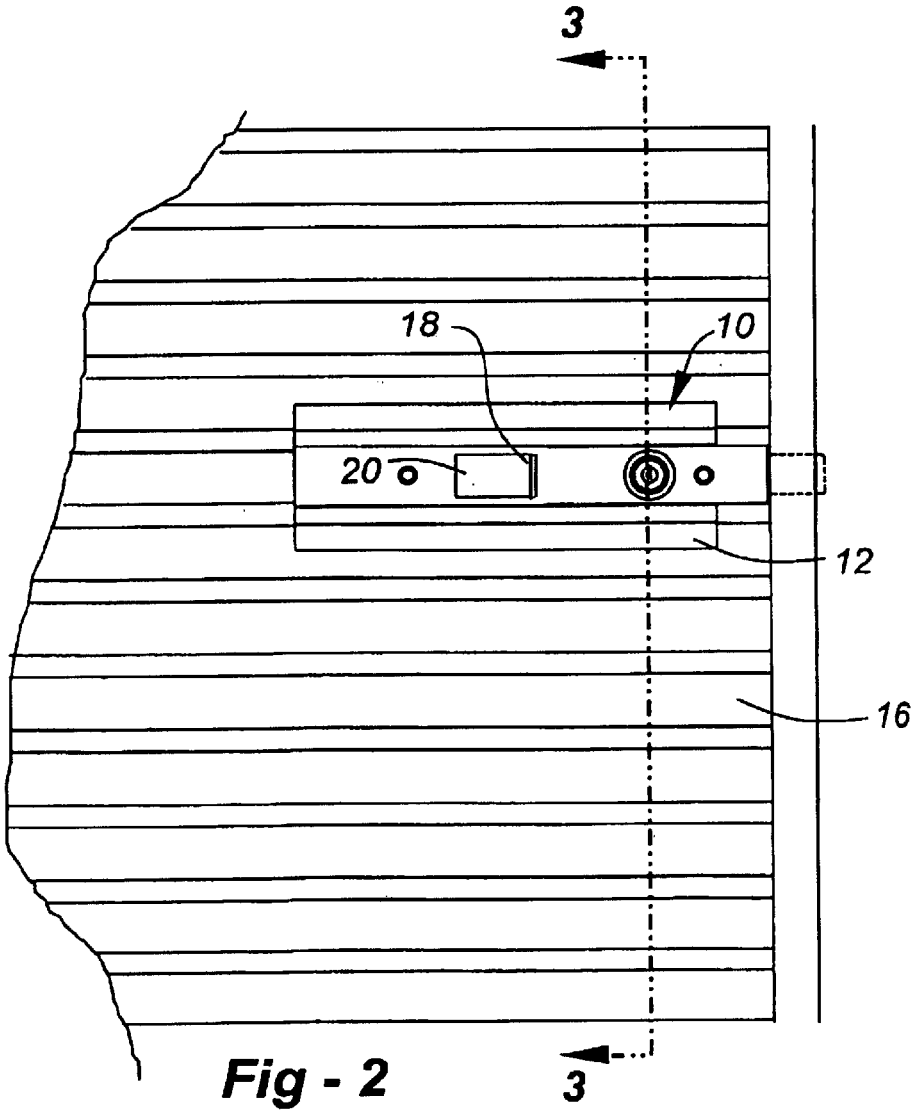
FIG. 2 is an elevational view of a portion of a door and track with the door latch of FIG. 1.
Figure 3:
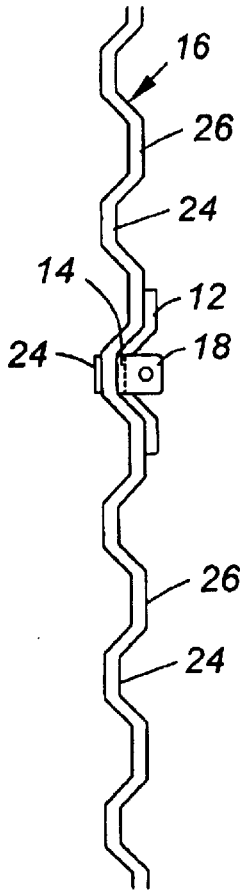
FIG. 3 is a cross-sectional view taken generally on line 3—3 in FIG. 2.
Figure 4:
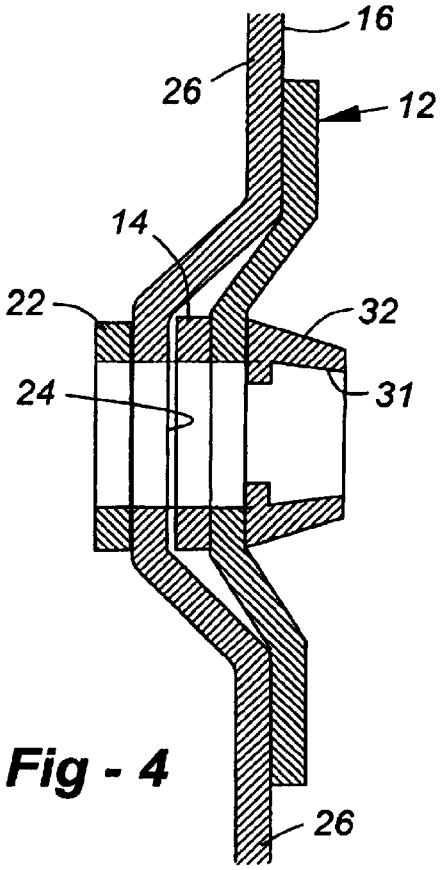
FIG. 4 is an enlarged view of a portion of the door and latch assembly seen in FIG. 3.

A typical door 16 for self-storage units is made of a thin corrugated steel material and is shown generally in FIGS. 2 and 3 and has recessed portions 24 and protruding portions 26 which alternate with each other. As seen in FIG. 4, the latch mechanism 10 is disposed in one of the recess portions 24 and the slide bar 14 is free to move between the rear of the body member 12 and the door 16.

Sliding movement of the bar 14 to the far right as shown in FIGS. 1 and 2 causes the slide bar 14 to engage in an opening (not shown) in a track 28 which is formed at opposite sides of the door 16 to guide it in a vertical path during opening and closing. To open the door 16 it is necessary to move the slide bar 14 to the left from the position seen in FIGS. 1 and 2. This is accomplished using the protruding handle 18 and moving it to the left end of the opening 20.

When the side bar 14 is in its locked position, a plug lock 30 can be inserted in an opening 31 in body member 12 having an annular flange 32 protruding from the face of body member 12. The opening 31 aligns with other openings in the slide bar 14 door 16 and backing plate 22. Insertion of the plug lock and locking it in position with a key prevents movement of the slide bar 14 from its latched or locked position in track 28.

It should be understood that other forms of lock mechanisms, such as padlocks, could be used with slight modification to the latch mechanism 10.

Figure 5:
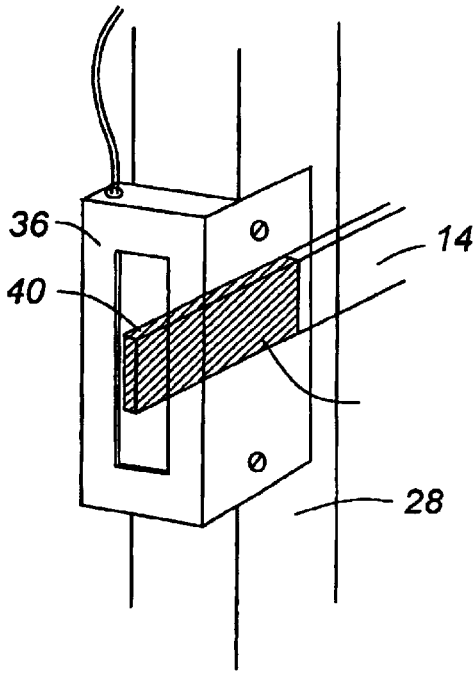
FIG. 5 is a perspective view demonstrating the relative positions of a magnetic alarm switch and portions of the door latch mechanism.

Referring now to FIG. 5, latch tongue or slide bar 14 is shown in its locked position in engagement with the track

28. In that position the tongue or bar 14 is in close proximity to a magnetic alarm switch 36, fastened to the door track 28. The switch 36 is used to send a signal to an alarm monitor not shown. Such monitors typically display the locked or unlocked condition of the various storage units at a central location. The latch mechanism must be compatible with electronic magnetic switches to energize the magnetic switch indicating the locked or unlocked condition of the door.

Figure 6:
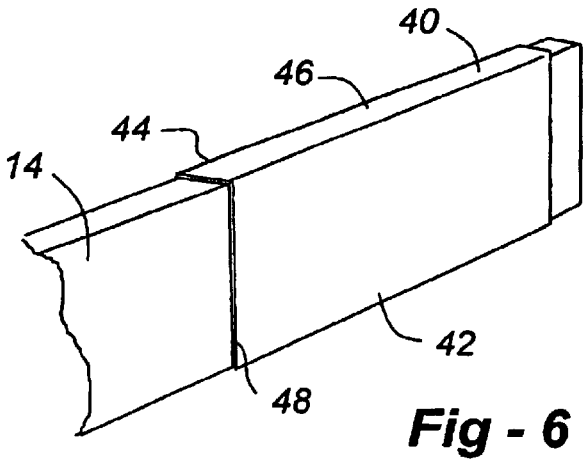
FIG. 6 is a photograph of the tip of a slide bar of the latch mechanism.
Figure 7:
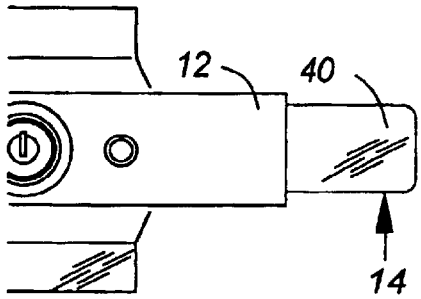
FIG. 7 is a photograph showing a portion of the body member and slide bar of the latch assembly embodying the invention.

As seen in FIGS. 6 and 7, the tip of the tongue 14 is provided with a sleeve of ferrous magnetic material indicated at 40. The sleeve 40 completely envelopes the tip of the slide bar 14, not only the front and back faces 42 and 44, respectively, but also the top edge 46, the bottom edge 48 and the free end or tip 50 with the slide bar 14.

A door latch mechanism has been provided which can be made of stainless steel material having non-magnetic qualities and which is provided with a magnetic sleeve in only that portion of the latch which is required to be in proximity to a magnetic switch to make it responsive and operative.

What is claimed is:

1. A latch mechanism for a door having an edge portion proximate to a jamb including a latch-bar receiving track, comprising:

a guide mounted on the edge portion of the door;

a latch bar with a tongue portion disposed in the guide, the latch bar being slidingly moveable between an extended position, where the tongue portion is received by the latch-bar receiving track, and a retracted position, wherein the tongue portion is not received by the latch-bar receiving track, enabling the door to be opened;

wherein latch bar is substantially composed of a substantially non-magnetic metallic material; and at least the tongue portion is coated with a ferrous material.

2. The latch mechanism of claim 1, wherein the non-magnetic material is stainless steel.

3. The latch mechanism of claim 1, further including a lock to maintain the tongue portion within the latch-bar receiving track.

4. A latch-bar configured for use with a door having an edge portion proximate to a jamb including a latch-bar receiving track and a magnetic switch in electrical communication with an alarm security monitor, comprising:

a stainless steel larch bar having a tongue portion which is coated with a ferrous material for compatibility with the magnetic switch.

5. A latch system for a door of the type used on a self-storage unit, comprising:

a corrugated metal door having an opening edge portion;

a jamb adjacent the opening edge portion when the door is closed, the jamb including a latch-bar receiving track;

a magnetically operated switch disposed in the jamb portion for sensing whether a ferrous latch bar has been received in the track;

a guide mounted on the edge portion of the door;

a non-magnetic, stainless steel latch bar having a tongue portion disposed in the guide, the latch bar being slidingly moveable between an extended position, where the tongue portion is received by the latch-bar receiving track, and a retracted position, wherein the tongue portion is not received by the latch-bar receiving track, enabling the door to be opened; and wherein at least the tongue portion is coated with a ferrous material for compatibility with the magnetically operated switch.

6. The latch mechanism of claim 5, further including a lock to maintain the tongue portion within the latch-bar receiving track.

7. A method of improving a latch mechanism of the type having a magnetically operated switch used to sense an all-ferrous latch bar, comprising the steps of:

removing the all-ferrous latch bar; and replacing it with a non-ferrous latch bar having a tongue portion coated with ferrous material to maintain operational compatibility with the magnetic switch.

8. A method of improving a latch mechanism of the type having a magnetically operated switch used to sense an all-ferrous latch bar, comprising the steps of:

removing the all-ferrous latch bar; and replacing it with a stainless steel latch bar having a tongue portion coated with ferrous material to maintain operational compatibility with the magnetic switch.

* * * * *